US005732420A

United States Patent [19]

Micciche

[11] Patent Number: 5,732,420

[45] Date of Patent: Mar. 31, 1998

[54] APPARATUS FOR CONTROLLING A SHOWER CURTAIN OR A SHOWER LINER

[76] Inventor: Alfonso S. Micciche, 18903 Quercux Dr., Apt. 26, Hudson, Fla. 34667

[21] Appl. No.: 739,522

[22] Filed: Oct. 29, 1996

[51] Int. Cl.[6] ..... A47K 3/22

[52] U.S. Cl. ..... 4/610; 4/559

[58] Field of Search ..... 4/558, 608–610, 4/559, 605; 160/336, 349.1, 349.2

[56] References Cited

U.S. PATENT DOCUMENTS

| | | | |
|---|---|---|---|
| 1,654,002 | 12/1927 | Kleinhamer | 160/349.2 |
| 2,293,883 | 8/1942 | Bossert | 4/609 X |
| 2,380,665 | 7/1945 | Morris | 4/608 |
| 2,855,041 | 10/1958 | Blashfield et al. | 160/336 |
| 3,808,610 | 5/1974 | Mortensen | 4/149 |
| 4,361,914 | 12/1982 | Oliver | 4/605 |
| 5,007,120 | 4/1991 | Annand | 4/558 |
| 5,103,531 | 4/1992 | Perrotta | 4/608 X |
| 5,305,477 | 4/1994 | Cochran | 4/609 |

FOREIGN PATENT DOCUMENTS

| | | | |
|---|---|---|---|
| 0370840 | 5/1990 | European Pat. Off. | 4/610 |

*Primary Examiner*—Charles E. Phillips
*Attorney, Agent, or Firm*—Joseph N. Breaux

[57] ABSTRACT

An apparatus for controlling a vertical draping of a shower curtain or a shower liner comprising a clipping member, a first quasi-box brace structure, a second quasi-box brace structure, and a horizontal bar structure having an in-use state and a non-use state. The horizontal bar structure comprises a first rod member coupled into the first quasi-box brace structure in said in-use state; a second rod member coupled to the second quasi-box brace structure and having the clipping member attached thereto; and locking and pivoting structure. In the in-use state, the first rod member and the second rod member are interlocked via the locking and pivoting structure for controlling the vertical draping of the shower curtain or the shower liner. In the non-use state, the first rod member and the second rod member are unlocked and the first rod member is pivoted downwardly until the first rod member is parallel with the second rod member. Additionally, in the non-use state, the first rod member is clipped in the clipping member.

18 Claims, 2 Drawing Sheets

APPARATUS FOR CONTROLLING A SHOWER CURTAIN OR A SHOWER LINER

TECHNICAL FIELD

The present invention relates a shower curtain holder apparatus, and more particularly, to an apparatus for controlling a shower curtain or a shower liner to maintain the vertical draping surface of a shower curtain or a shower liner away from a user's body when the user is showering. The apparatus for controlling a shower curtain or a shower liner is durable, sturdy, easily installed, easily unlocked and easily folded away for future use.

BACKGROUND OF THE INVENTION

Typically when taking a shower, the vertical draping surface of a shower curtain or a shower liner is extended across the length of a bathtub. The lower most portion of the vertical draping surface of a shower curtain or a shower liner rests against the interior surface of one of the sides of the bathtub wherein said one of the sides is the entrance into the bathtub. As the vertical draping surface of a shower curtain or a shower liner rests against the aforementioned surface of the bathtub, water is maintained within the confines of the bathtub cavity thereby preventing water from soaking the bathroom floor. However, as the user takes a shower, occasionally, the user's body comes in contact with the shower curtain or the shower liner. Since shower curtains or shower liners are typically made of light weight plastics or the like, when the user's wet body comes in contact with the shower curtain or the shower liner, the shower curtain or the shower liner quickly sticks to the user's wet body; henceforth, water often escapes the confines of the bathtub cavity, wetting the bathroom floor, and the user experiences a cold draft of air. Moreover, on occasion, an air draft in the bathroom blows the shower curtain or the shower liner toward the user's wet body. Again, water often escapes the confines of the bathtub cavity, wetting the bathroom floor, and the user experiences a cold draft of air.

Bathtubs are made of materials such as metals, plastics or fiberglass. To solve the aforementioned problems, magnets were placed in the lower most corners of the vertical draping surface of the shower curtain or the shower liner which magnetically attach to the bathtubs of the metal type. This solution was only somewhat effective when used with metal type bathtubs and ineffective when used with plastic or fiberglass type bathtubs.

Several devices have been patented which are aimed at controlling the shower curtain or the shower liner.

U.S. Pat. No. 5,007,120, by Annand, is directed to a shower curtain liner control device wherein a rod device is placed around the shower curtain rod and radially projects downward along the vertical length of a shower liner. The lower most portion of the rod device has formed a hook shaped member whereby the curvature of the hook shaped member pushes the shower liner away from the bathtub cavity. A lever moves the radially projected rod device and its hook shaped member thereby moving the shower curtain liner away from the bathtub cavity. The rod device, by Annand, only controls the shower liner in a tent formation manner. Therefore, several curtain liner control devices must be deployed. Furthermore, the use of the hook shaped member is extremely hazardous to the user since the shower curtain liner control device is used in the confines of the bathtub cavity, a relatively small area.

U.S. Pat. No. 3,808,610, by Mortensen, is directed to a shower curtain guard for preventing water from exiting the bathtub when a user showers. The shower curtain guard is a vertical device extending the vertical length of a side of a shower curtain or a shower liner to prevent water from flooding the floor of the bathroom.

U.S. Pat. No. 5,305,477, by Cochran, is directed to a shower curtain brace for securing the lower most portion of the vertical draping of a shower curtain or a shower liner in a shower stall. The shower curtain brace, by Cochran, is for use in shower stalls and not directed to bathtubs.

U.S. Pat. No. 4,361,914, by Oliver, is directed to a shower curtain holder for controlling a shower curtain or a shower liner away from the user's body. The curtain holder is a horizontal rod which extends the length of the bathtub. The curtain holder is made of a metal type material which is easily bent, easily dented and easily damaged. Furthermore, the shower curtain holder is not easily installed, easily unlocked and easily folded away for future uses as is the present invention.

The known shower curtain holder apparatuses for controlling a shower curtain or a shower liner do not address the need for an apparatus for controlling a shower curtain or a shower liner to maintain the vertical draping surface of a shower curtain or a shower liner away from a user's body when the user is showering which is durable, sturdy, easily installed, easily unlocked and easily folded away for future use.

SUMMARY OF THE INVENTION

The preferred embodiment of the apparatus for controlling a shower curtain or a shower liner of the present invention solves the aforementioned problems in a straight forward and simple manner. What is provided is an apparatus for controlling a shower curtain or a shower liner to maintain the vertical draping surface of a shower curtain or a shower liner away from a user's body when the user is showering. The apparatus for controlling a shower curtain is durable, sturdy, easily installed, easily unlocked and easily folded away for future use.

In view of the above, an object of the invention is to provide an apparatus for controlling the vertical draping of a shower curtain or a shower liner comprising a horizontal bar structure, first and second quasi-box brace structures and a clip member which are made of a durable and strong plastic or the like thereby increasing the useful life of said apparatus. The durable and strong plastic minimizes bending, dents or other surface damage, such as rust and corrosion.

A further object of the invention is to provide a horizontal bar structure having a in-use state and a non-use state wherein first and second rod members are interlocked in the in-use state and easily unlocked for the non-use state.

A further object of the invention is to provide an apparatus for controlling the vertical draping of a shower curtain or a shower liner having a clip member for intercoupling the first and second rod members of the horizontal bar structure together in the non-use state wherein, as the first rod member is manually pivoted downward until parallel with the second rod member, the bottom surface of cylindrically shaped first rod member abuts against the bottom surface of cylindrically shaped second rod member and engages with the clip member. As the first rod member engages with the clip member, first and second rod members are intercoupled.

Another object of the invention is to provide first and second quasi-box brace structures which securely attach to the bathroom wall surfaces for supporting the horizontal bar structure. During the non-use state, second rod member pivots upward toward the bathroom wall surface and rests thereagainst until said apparatus of the present invention is deployed in the in-use state during the next shower.

It is thus an object of the invention to provide a locking and pivoting means having a latch mechanism and a latch release tab means for easily interlocking and unlocking first and second rod members of the horizontal bar structure.

It is a further object of the invention to provide a locking and pivoting means having a curved support ledge which provides support when the first and second rod member are interlocked thereby protecting the mating connection of first and second rod members from damage and misalignment. The curved support ledge further provides protection if the user places his or her weight on the horizontal bar structure while showering.

It is a still further object of the invention to provide an apparatus for controlling the vertical draping of a shower curtain or a shower liner which is easily installed to the bathroom wall surfaces and adaptable for attachment thereto for a variety of bathroom layouts.

It is a still further object of the invention to provide an apparatus for controlling the vertical draping of a shower curtain or a shower liner which is adaptable for varying bathtub lengths.

It is a still further object of the invention to provide an apparatus for controlling the vertical draping of a shower curtain or a shower liner which is inexpensive.

It is a still further object of the invention to provide an apparatus for controlling a shower curtain or a shower liner which is easily manufactured.

The above objects and other features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
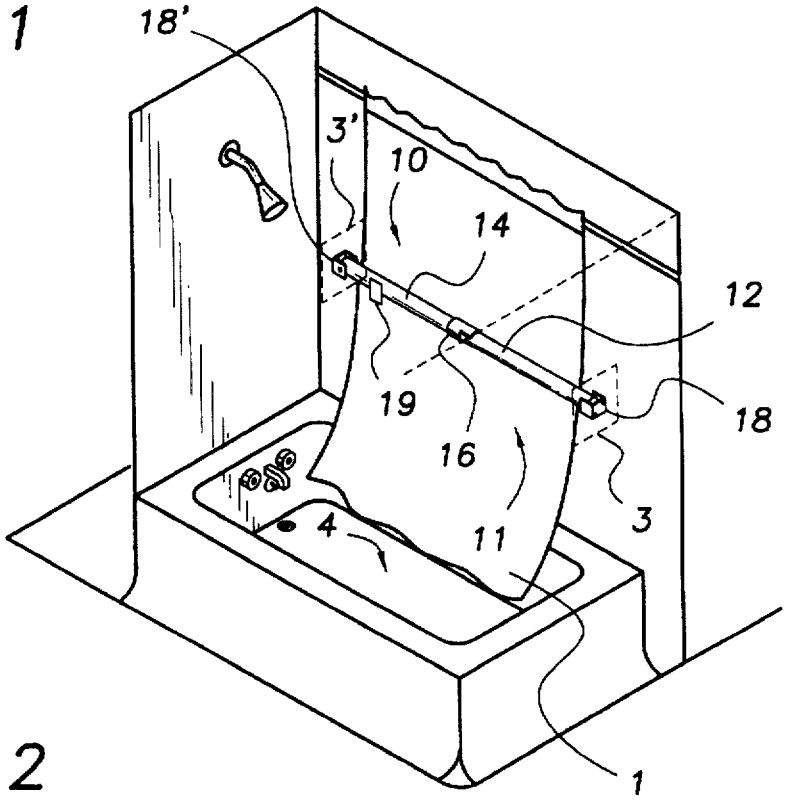
FIG. 1 illustrates a perspective view of the apparatus of the present invention, installed and deployed for the in-use state for controlling a shower curtain or a shower liner in a bathtub in accordance with a preferred embodiment of the present invention.

Referring now to the drawings, and in particular FIG. 1, the apparatus for controlling a shower curtain or a shower liner of the present invention is designated generally by the numeral 10. Apparatus for controlling a shower curtain or a shower liner 10 comprises horizontal bar structure 11, first attachment bracing means 18, second attachment bracing means 18' and clip member 19.

Figure 2:
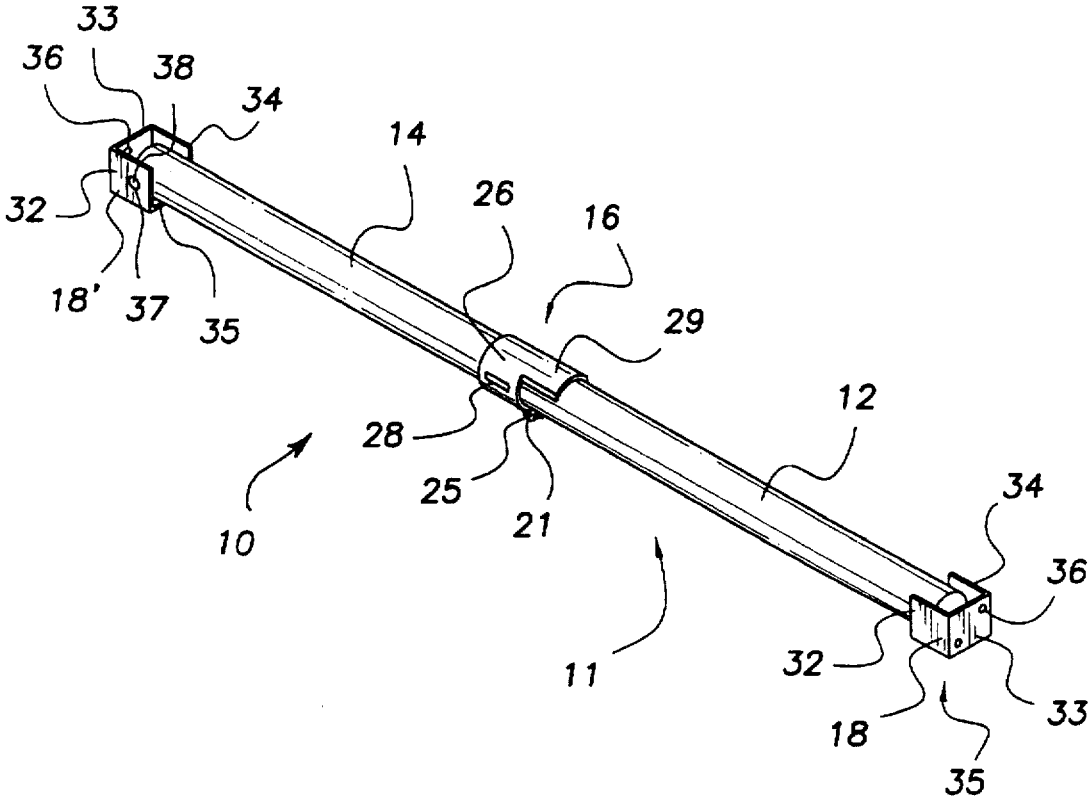
FIG. 2 illustrates an exploded view of the apparatus of the present invention of FIG. 1.
Figure 3:
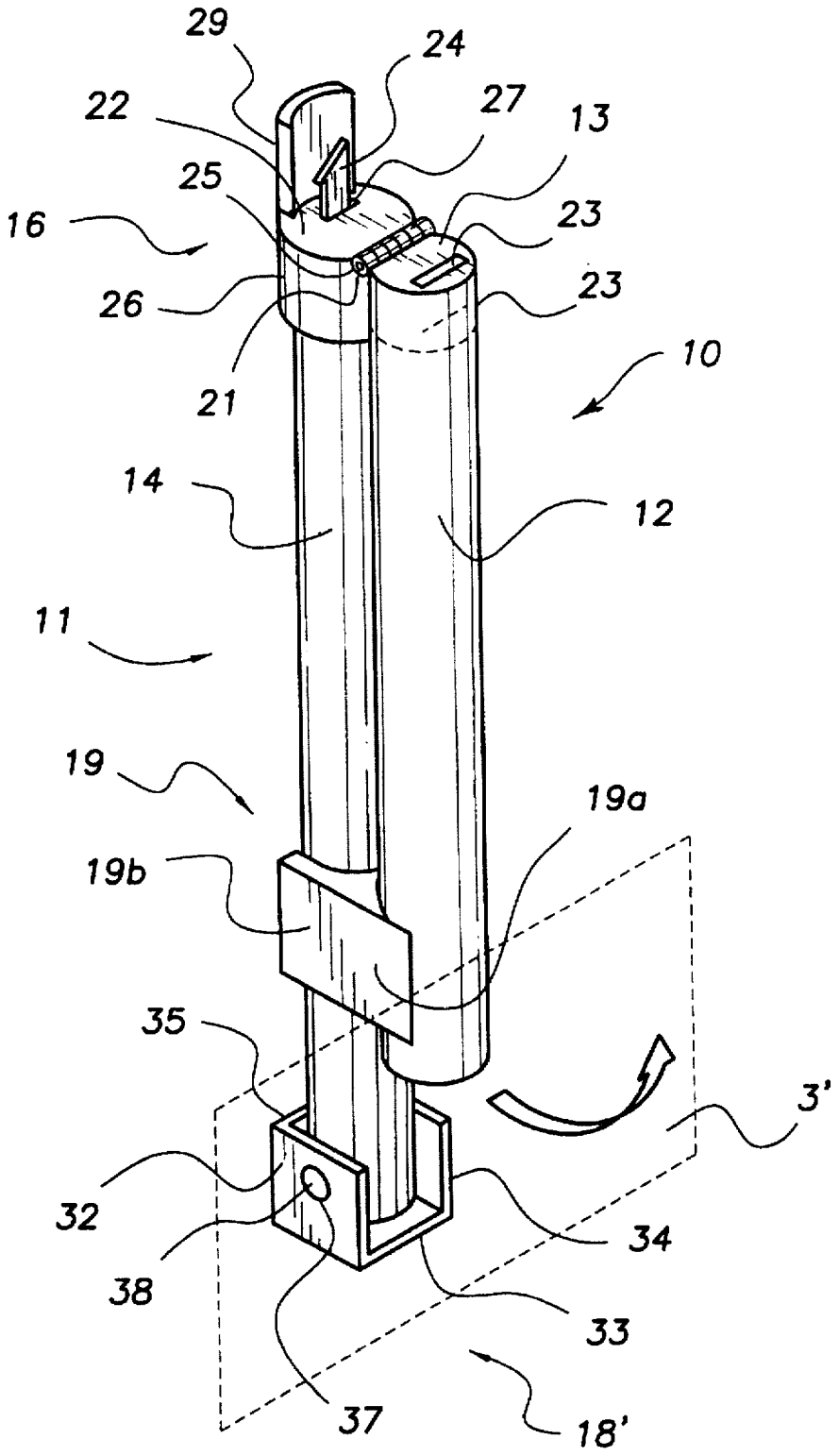
FIG. 3 illustrates a detailed view of the apparatus folded in the non-use state and resting against the bathroom wall surface of the present invention of FIG. 1.

Referring now to FIGS. 2 and 3, horizontal bar structure 11 comprises first rod member 12, second rod member 14 and locking and pivoting means 16. First rod member 12 and second rod member 14 are cylindrically shaped rods made of a durable and strong plastic or the like. The use of a durable and strong plastic increases the useful life of first and second rod members 12 and 14 whereby bending, dents or other surface damage is greatly minimized when horizontal bar structure 11 is installed and deployed in use for controlling the vertical draping surface of a shower curtain or a shower liner 1 (FIG. 1). Preferably, first and second rod members 12 and 14 are hollow cylindrically shaped plastic rods; henceforth, horizontal bar structure 11 is lightweight, durable and sturdy. Nevertheless, first and second rod members 12 and 14 may be solid cylindrically shaped rods.

Locking and pivoting means 16 comprises aperture 23, latch mechanism 24, pivot hinge member 25, latch jacket member 26, aperture 27, latch release tab means 28 and curved support ledge 29. One distal end of first rod member 12 has circular surface member 13 having formed therein aperture 23. One distal end of second rod member 14 has fixedly coupled thereto latch jacket member 26. Latch jacket member 26 is a cylindrically shaped jacket having an inner circumference, such that latch jacket member 26 tightly matingly couples around the outer circumference of said one distal end of second rod member 14. Latch jacket member 26 comprises circular surface member 22 having formed therein aperture 27 from which latch mechanism 24 protrudes therefrom. When first and second rod members 12 and 14 are interlocked, latch mechanism 24 enters aperture 23 formed in circular surface member 13 of first rod member 12 and latches therein.

Latch jacket member 26 fixedly couples to curved support ledge 29 perpendicularly extending therefrom. The curvature of curved support ledge 29 conforms to the top portion of cylindrically shaped first rod member 12 wherein when first and second rod members 12 and 14 are interlocked, curved support ledge 29 provides a support ledge for first rod member 12 and provides support for the point of interlocking between first and second rod members 12 and 14. Moreover, curved support ledge 29 protects latching mechanism 24 and mating connection thereof from damage, misalignment, etc. when first and second rod members 12 and 14 are interlocked and deployed in the in-use state. Specifically, when horizontal bar structure 11 is in the interlocked position for controlling the vertical draping surface of a shower curtain or a shower liner 1 (FIG. 1), the user when showering may place his or her weight on horizontal bar structure 11. Henceforth, curved support ledge 29 supports the interlocking of first and second rod members 12 and 14.

First and second rod members 12 and 14 are pivotally coupled together via pivot hinge member 25 wherein as first rod member 12 pivots about pivot pin 21 of pivot hinge member 25, circular surface member 13 abuts against circular surface member 22 of latch jacket member 26 and aperture 23 and aperture 27 are thereby aligned together. As aperture 23 and aperture 27 align, latch mechanism 24 enters aperture 23 and latches therein thereby interlocking first and second rod members 12 and 14, theretogether. First and second rod members 12 and 94 are unlocked by latch release tab means 28 when latch release tab means 28 is actuated. Latch release tab means 28 is coupled to one of the sides of latch jacket member 26. As latch release tab means 28 is pressed, latch mechanism 24 unlatches and recedes from aperture 23 thereby unlocking first and second rod members 12 and 14. First rod member 12 is then manually pivoted downwardly until parallel with second rod member 14 about pivot pin 21 of pivot hinge member 25 and secured to second rod member 14 via clip member 19. Pivot hinge member 25 is fixedly coupled to the bottom surface of said one distal end of first rod member 12 immediately perpendicular to circular surface member 13 and to the bottom surface of latch jacket member 26 immediately perpendicular to circular surface member 22. In the exemplary embodiment, clip member 19, latch mechanism 24, pivot hinge member 25, latch jacket member 26, latch release tab means 28 and curved support ledge 29 are made of durable and strong plastic or the like. Pivot pin 21 is made of stainless steel or any other suitable metal or metal alloy which is not susceptible to rusting and corroding.

Second rod member 14 has matingly coupled thereto clip member 19. Clip member 19 comprises first semi-cylindrical clipping member **19*a* and second semi-cylindrical clipping member 19*b*. First and second semi-cylindrical clipping members 19*a* and 19*b* each have a diameter substantially equal to the outer diameters of first and second rod members 12 and 14, respectively, for securely coupling thereto. First rod member 12 clips into first semi-cylindrical clipping member 19*a* after first rod member 12 has been fully pivoted about pivot pin 21 of pivot hinge member 25. First and second semi-cylindrical clipping members 19*a* and 19*b* are dimensioned to have a sufficient holding capacity while allowing first rod member 12 to be easily unclipped from the clipping force of first semi-cylindrical clipping member 19*a***.

The other distal end of first rod member 12 matingly rests in first attachment bracing means 18 and the other distal end of second rod member 14 securely rests in second attachment bracing means 18'. First attachment means 18 and second attachment means 18' are identical in structure. Since first attachment means 18 and second attachment means 18' are identical in structure, it will be necessary to describe only one such attachment means in detail. First attachment means 18 comprises first, second, and third wall surfaces 32, 33 and 34 and bottom wall surface 35. One edge of first wall surface 32 perpendicularly couples to one edge of second wall surface 33. The other edge of second wall surface 33 perpendicularly couples to one edge of third wall surface 34, such that first wall surface 32 and third wall surface 34 are parallel and interior surface areas thereof face each other. The bottom edges of first, second and third wall surfaces 32, 33 and 34, as coupled theretogether, perpendicularly couple to bottom wall surface 35 thereby forming a quasi-box brace structure. First attachment means 18 and second attachment means 18' are hereinafter referred to as "first quasi-box brace structure" and "second quasi-box brace structure," respectively. In the exemplary embodiment, second wall surface 33 has formed therein a plurality of apertures 36, for receiving therethrough a securing means (not shown), such as a screw or bolt for attaching first attachment means 18 and second attachment means 18' to bathroom wall surfaces 3 and 3' (FIG. 1), respectively. Alternatively, first and third wall surfaces 32 and 33 may also have formed therein a plurality of apertures (not shown) similar to apertures 36, for receiving therethrough a securing means (not shown) such that first attachment means 18 and second attachment means 18' may be installed to accommodate bathrooms having various layouts. Bottom wall surface 35 forms a ledge wherein first rod member 12 matingly rests on said ledge of said first quasi-box brace structure when first rod member 12 is placed therein. First rod member 12 is easily placed in said first quasi-box brace structure when horizontal bar structure 11 is deployed in the in-use state and easily removed from said first quasi-box brace structure. First rod member 12 is easily removed from said first quasi-box brace structure by slightly rotating second rod member 14 upward about securing rod member 38. Thereafter, first rod member 12 is unlocked for placing horizontal bar structure 11 in the non-use state. Said first quasi-box brace structure is dimensioned to have a sufficient length to support first rod member 12 therein for accommodating slightly varying bathtub lengths.

In the preferred embodiment, said first quasi-box brace structure and said second quasi-box brace structure are fixedly attached to bathroom wall surfaces 3 and 3' (FIG. 1), respectively, slightly beyond the outer most surface of the bathtub cavity 4 (FIG. 1). Preferably, second quasi-box brace structure is attached to a wall of the bathroom in close proximity of the shower head.

Second attachment means 18' differs from first attachment means 18 in that first wall surface 32 and third wall surface 34 each have aperture 37 formed therein for receiving therethrough securing rod member 38. The other distal end of second rod member 14 has formed therein two aligned apertures (not shown) one on each side of second rod member 14. Said two aligned apertures are aligned with aperture 37 of first wall surface 32 and third wall surface 34 wherein securing rod member 38 passed through said two aligned apertures and aperture 37 of first wall surface 32 and third wall surface 34. Alternatively, for accommodating a variety of bathtub lengths, second attachment means 18' may have a plurality of aligned apertures, similar to aperture 37, formed along the surface of first wall surface 32 and third wall surface 34 whereby securing rod member 38 may be positioned in one of the plurality of apertures which best accommodates the bathtub length.

In the exemplary embodiment, in the non-use state, second rod member 14 is manually rotated upward about securing rod member 38 toward bathroom wall surface 3' (FIG. 1). Henceforth, in the non-use state, horizontal bar structure 11 is positioned vertically along bathroom wall surface 3' (FIG. 1) whereby horizontal bar structure 11 maintains such vertical position until the next shower.

In the preferred embodiment, first and second rod members 12 and 14 are manufactured using a plastic extrusion process. The plastic extrusion process heats softened plastic which is forced under high pressure through a die. The plastic forms a continuous length in the shape of the die wherein the die is dimensioned to the cylindrical diameter of first and second rod members 12 and 14. The rod members formed from the plastic extrusion process are cut to the desired length thereby forming first and second rod members 12 and 14.

The components of locking and pivoting means 16 are manufactured using a plastic injection molding process wherein heat is used to soften plastic material, which is forced under very high pressure into a metal cavity mold which is relatively cool. Acceptable metals for the mold are aluminum and steel. The inside cavity of the mold comprises two or more halves to form desired shape. High pressure hydraulics is used to keep the mold components together during the actual injection phase of the molding process. The injected plastic is allowed to cool and harden. Th hydraulics holding the multiple component cavity together is released, the halves of the mold separate and the solid formed plastic components are removed. Injection molding is a highly automated process and produces extremely detailed parts at a very cost effective price.

It is noted that the embodiment of the apparatus for controlling the vertical draping of the shower curtain or the shower liner described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An apparatus for controlling a vertical draping of a shower curtain or a shower liner comprising:

a horizontal bar structure having an in-use state and a non-use state, said horizontal bar structure comprises:

first rod member attached to a second rod member by a locking and pivoting means;

means for attaching said horizontal bar structure to a wall;

wherein, in the in-use state, said first rod member and said second rod member are interlocked in an end to end orientation via said locking and pivoting means to form said horizontal bar structure for controlling the vertical draping of said shower curtain or said shower liner; and, in the non-use state, said first rod member and said second rod member are unlocked and said first rod member is pivoted downwardly until said first rod member is juxtaposed with said second rod member.

2. The apparatus for controlling the vertical draping of the shower curtain or the shower liner of claim 1, wherein said locking and pivoting means comprises:

a first aperture formed in a circular surface of one distal end of said first rod member;

a latch jacket member matingly coupled to one distal end of said second rod member wherein said latch jacket member comprises a circular surface having a second aperture formed therein;

a latch mechanism protruding from said second aperture and latches in said first aperture in said in-use state;

pivot hinge member for pivoting said first rod member to interlock with said second rod member in said in-use state and pivoting said first rod member downward in said non-use state; and latch release tab means coupled to said latch jacket member wherein when said latch release tab means is actuated, said latch mechanism is unlatched and receded from said first aperture.

3. The apparatus for controlling the vertical draping of the shower curtain or the shower liner of claim 1, further comprising a clip member, said clip member comprises:

a first semi-cylindrical clipping member; and a second semi-cylindrical clipping member coupled to said second rod member;

wherein said first and second semi-cylindrical clipping members are shaped to have a diameter substantially equal to an outer diameter of said first rod member and said second rod member, respectively; and wherein, in said non-use state, said first rod member is clipped into said first semi-cylindrical clipping member.

4. The apparatus for controlling the vertical draping of the shower curtain or the shower liner of claim 1, further comprising first means for attaching and second means for attaching, the first attaching means and the second attaching means each comprises:

a first wall surface;

a second wall surface;

a third wall surface; and a bottom wall surface;

wherein one edge of said first wall surface perpendicularly couples to one edge of said second wall surface, the other edge of said second wall surface perpendicularly couples to one edge of said third wall surface; wherein said first wall surface and said third wall surface are parallel and interior surface areas thereof face each other; and wherein bottom edges of said first, second and third wall surfaces perpendicularly couple to said bottom wall surface for forming a quasi-box brace structure.

5. The apparatus for controlling the vertical draping of the shower curtain or the shower liner of claim 4, wherein, in the non-use state, said second rod member is rotated about a shaft member of said second attaching means and is rotated upward to rest against a bathroom wall surface.

6. The apparatus for controlling the vertical draping of the shower curtain or the shower liner of claim 1, wherein said first rod member and said second rod member are cylindrically shaped rods made of a durable and strong plastic.

7. An apparatus for controlling a vertical draping of a shower curtain or a shower liner comprising:

a first means for attaching;

a second means for attaching; and a horizontal bar structure having an in-use state and a non-use use state, said horizontal bar structure comprises:

first rod member coupled into the first means for attaching in said in-use state, second rod member coupled to the second attaching means, and locking and pivoting means for pivotally attaching said first rod member to said second rod member in an end to end orientation;

wherein, in the in-use state, said first rod member and said second rod member are interlocked via said locking and pivoting means for controlling the vertical draping of said shower curtain or said shower liner; and, in the non-use state, said first rod member and said second rod member are unlocked and said first rod member is pivoted downwardly until said first rod member is juxtaposed with said second rod member.

8. The apparatus for controlling the vertical draping of the shower curtain or the shower liner of claim 7, wherein said locking and pivoting means comprises:

a first aperture formed in a circular surface of one distal end of said first rod member;

a latch jacket member matingly coupled to one distal end of said second rod member wherein said latch jacket member comprises a circular surface having a second aperture formed therein;

a latch mechanism protruding from said second aperture and latches in said first aperture in said in-use state;

pivot hinge member for pivoting said first rod member to interlock with said second rod member in said in-use state and pivoting said first rod member downward in said non-use state; and latch release tab means coupled to said latch jacket member wherein when said latch release tab means is actuated, said latch mechanism is unlatched and receded from said first aperture.

9. The apparatus for controlling the vertical draping of the shower curtain or the shower liner of claim 7, further comprising a clip member, said clip member comprises:

a first semi-cylindrical clipping member; and a second semi-cylindrical clipping member coupled to said second rod member;

wherein said first and second semi-cylindrical clipping members are shaped to have a diameter substantially equal to an outer diameter of said first rod member and said second rod member, respectively; and wherein, in said non-use state, said first rod member is clipped into said first semi-cylindrical clipping member.

10. The apparatus for controlling the vertical draping of the shower curtain or the shower liner of claim 7, wherein the first attaching means and the second attaching means each comprises:

a first wall surface;

a second wall surface;

a third wall surface; and a bottom wall surface;

wherein one edge of said first wall surface perpendicularly couples to one edge of said second wall surface, the other edge of said second wall surface perpendicularly couples to one edge of said third wall surface; wherein said first wall surface and saidthird wall surface are parallel and interior surface areas thereof face each other; and wherein bottom edges of said first, second and third wall surfaces perpendicularly couple to said bottom wall surface for forming a quasi-box brace structure.

11. The apparatus for controlling the vertical draping of the shower curtain or the shower liner of claim 10, wherein, in the non-use state, said second rod member is rotated about a shaft member of said second attaching means and is rotated upward to rest against a bathroom wall surface.

12. The apparatus for controlling the vertical draping of the shower curtain or the shower liner of claim 7, wherein said first rod member and said second rod member are cylindrically shaped rods made of a durable and strong plastic.

13. An apparatus for controlling a vertical draping of a shower curtain or a shower liner comprising:

a clipping member;

a first means for attaching;

a second means for attaching; and a horizontal bar structure having an in-use state and a non-use state, said horizontal bar structure comprises:

first rod member coupled into the first means for attaching in said in-use state, second rod member coupled to the second attaching means and having said clipping member attached to said second rod member, and locking and pivoting means;

wherein, in the in-use state, said first rod member and said second rod member are interlocked via said locking and pivoting means for controlling the vertical draping of said shower curtain or said shower liner; and, in the non-use state, said first rod member and said second rod member are unlocked and said first rod member is pivoted downwardly until said first rod member is parallel with said second rod member; and wherein said first rod member is clipped in said clipping member in said non-use state.

14. The apparatus for controlling the vertical draping of the shower curtain or the shower liner of claim 13, wherein said locking and pivoting means comprises:

a first aperture formed in a circular surface of one distal end of said first rod member;

a latch jacket member matingly coupled to one distal end of said second rod member wherein said latch jacket member comprises a circular surface having a second aperture formed therein;

a latch mechanism protruding from said second aperture and latches in said first aperture in said in-use state;

pivot hinge member for pivoting said first rod member to interlock with said second rod member in said in-use state and pivoting said first rod member downward in said non-use state; and latch release tab means coupled to said latch jacket member wherein when said latch release tab means is actuated, said latch mechanism is unlatched and receded from said first aperture.

15. The apparatus for controlling the vertical draping of the shower curtain or the shower liner of claim 13, wherein said clipping member comprises:

a first semi-cylindrical clipping member; and a second semi-cylindrical clipping member coupled to said second rod member;

wherein said first and second semi-cylindrical clipping members are shaped to have a diameter substantially equal to an outer diameter of said first rod member and said second rod member, respectively.

16. The apparatus for controlling the vertical draping of the shower curtain or the shower liner of claim 13, wherein the first attaching means and the second attaching means each comprises:

a first wall surface;

a second wall surface;

a third wall surface; and a bottom wall surface;

wherein one edge of said first wall surface perpendicularly couples to one edge of said second wall surface, the other edge of said second wall surface perpendicularly couples to one edge of said third wall surface; wherein said first wall surface and said third wall surface are parallel and interior surface areas thereof face each other; and wherein bottom edges of said first, second and third wall surfaces perpendicularly couple to said bottom wall surface for forming a quasi-box brace structure.

17. The apparatus for controlling the vertical draping of the shower curtain or the shower liner of claim 16, wherein, in the non-use state, said second rod member is rotated about a shaft member of said second attaching means and is rotated upward to rest against a bathroom wall surface.

18. The apparatus for controlling the vertical draping of the shower curtain or the shower Liner of claim 13, wherein said first rod member and said second rod member are cylindrically shaped rods made of a durable and strong plastic.

* * * * *